US008445071B2

(12) United States Patent
Egawa

(10) Patent No.: US 8,445,071 B2
(45) Date of Patent: May 21, 2013

(54) PROCESS FOR PRODUCING ELECTROPHOTOGRAPHIC BELT

(75) Inventor: Noriaki Egawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 386 days.

(21) Appl. No.: 12/277,948

(22) Filed: Nov. 25, 2008

(65) Prior Publication Data

US 2009/0142501 A1 Jun. 4, 2009

(30) Foreign Application Priority Data

Nov. 30, 2007 (JP) ..... 2007-309706

(51) Int. Cl.
*B05D 3/02* (2006.01)

(52) U.S. Cl.
USPC ..... 427/385.5; 427/353

(58) Field of Classification Search
USPC ..... 427/385.5, 353
See application file for complete search history.

(56) References Cited

U.S. PATENT DOCUMENTS 5,906,904 A * 5/1999 Parikh et al. ..... 430/69
2006/0240248 A1* 10/2006 Kanai ..... 428/336

FOREIGN PATENT DOCUMENTS

JP 2000-255817 9/2000

* cited by examiner

*Primary Examiner* — Robert S Walters, Jr.
(74) *Attorney, Agent, or Firm* — Fitzpatrick, Cella, Harper & Scinto

(57) ABSTRACT

A process by which an electrophotographic belt having a protective layer more containing a filler on its surface side can be produced at a lower cost. The process is a process for producing an electrophotographic belt having a base layer and a surface layer, and has the steps of (1) forming on the base layer a wet coating of a surface layer forming coating liquid in which a filler has been dispersed and a binder resin stands dissolved; (2) making water adhere to the surface of the wet coating; and (3) drying the wet coating to form the surface layer. The filler is a filler the affinity of which for the water is higher than the affinity the filler has for a dispersion medium of the filler in the coating-liquid.

5 Claims, 4 Drawing Sheets

PROCESS FOR PRODUCING ELECTROPHOTOGRAPHIC BELT

BACKGROUND OF THE INVENTION

1. Field of the Invention

This invention relates to a process for producing a belt used in electrophotographic image forming apparatus (hereinafter also an "electrophotographic belt". The electrophotographic belt includes as examples thereof an intermediate transfer belt which temporarily holds thereon toner images transferred from an image bearing member and from which the toner images are transferred to a transfer material.

2. Description of the Related Art

As a construction of the electrophotographic belt such as the intermediate transfer belt, a belt is known which has a multi-layer structure having a base material with a good strength and a protective layer for improving cleanability and wear resistance.

Here, as the protective layer, a protective layer containing a resin (hereinafter also a "resinous protective layer") is commonly used in order to satisfy the flexibility that is required for the belt. In this case, it is proposed to add various fillers for the purposes of controlling resistivity and surface roughness of the resinous protective layer and reinforcing the same. However, the addition of fillers to the resinous protective layer may make the resinous protective layer brittle, depending on the amount in their addition. To resolve such a problem, Japanese Patent Laid-open Application No. 2000-255817 discloses a conductive belt having a conductive layer and a protective layer formed on the conductive layer, said protective layer comprising a conductive filler and said conductive filler being gradually dispersed in the protective layer so that the content of a conductive filler increases from the conductive layer towards the surface side (gradient in the thickness direction). Then, this patent document discloses that a protective layer more containing the filler on the surface side can be produced with ease by centrifugal molding.

The present inventor has made studies on methods for producing by centrifugal molding a protective layer more containing a filler toward its surface side. As a result, he has found it difficult for such methods to reduce production cost of belts, because the employment of centrifugal molding requires a high cost for its equipment and also a long molding process.

SUMMARY OF THE INVENTION

Accordingly, an object of the present invention is provide a process by which an electrophotographic belt having a protective layer more containing the filler on the surface side can be produced at a lower cost.

According to the present invention, there is provided a process for producing an electrophotographic belt having a base layer and a surface layer; the process comprising the steps of:

(1) forming on said base layer a wet coating of a surface layer forming coating-liquid, said surface layer forming coating-liquid comprising a filler dispersed therein, and a binder resin dissolved therein;

(2) making water adhere to said surface of the wet coating; and (3) drying said wet coating to form said surface layer;

wherein an affinity of said filler for water is higher than that for a dispersion medium of said filler in said surface layer forming coating-liquid.

According to the present invention, a protective layer more containing the filler on the surface side can be formed by utilizing a high affinity the filler has for the water, in the course where the wet coating of the surface layer forming coating liquid is dried.

Further features of the present invention will become apparent from the following description of exemplary embodiments with reference to the attached drawings.

DESCRIPTION OF THE EMBODIMENTS

Figure 1:
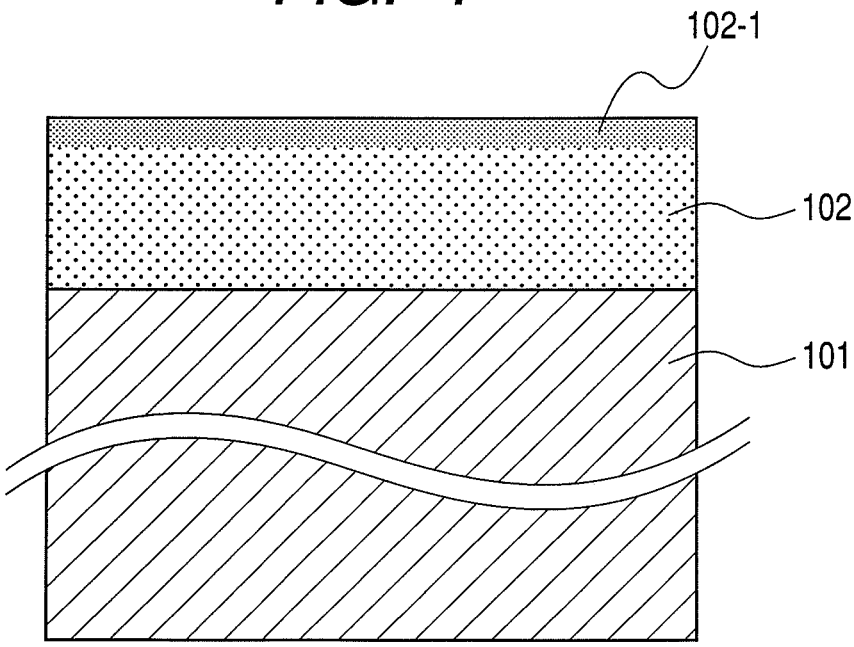
FIG. 1 is a schematic sectional view of an electrophotographic belt having a double-layer structure consisting of a base layer and a surface layer in which the filler is so distributed as to be more contained on the surface side.

The present invention is concerned with a process for producing an electrophotographic belt having, as shown in FIG. 1, a base layer 101 and a surface layer 102, where the surface layer 102 contains a filler and a binder resin. In the surface layer 102, the filler is unevenly so distributed as to be more contained towards the surface side (102-1) of the surface layer 102.

FIG. 1, to make it easy to understand the present invention, diagrammatically illustrates a state in which the filler is more contained toward the surface side of the surface layer 102. That is, FIG. 1 is by no means what shows that it is essential for the surface layer 102 according to the present invention to have as a layer a region 102-1 composed of only the filler.

The production process of the present invention has the following steps (1) to (3).

(1) The step of forming on the base layer 101 a wet coating of a surface layer forming coating liquid in which the filler has been dispersed and the binder resin stands dissolved;

(2) the step of making water adhere to the surface of the wet coating; and (3) the step of drying the wet coating to form the surface layer 102.

Then, the affinity of the filler for water is higher than that for a dispersion medium of the filler in the surface layer forming coating-liquid.

The reason why the filler comes unevenly so distributed as to be more contained on the surface side of the surface layer 102 is considered due to the following phenomenon.

That is, in the course the wet coating of the surface layer forming coating-liquid is dried, water is present on the surface of the wet coating, where the filler is drawn to the water on the surface side because it has a higher affinity for water than the affinity for the dispersion medium which is still present in the wet coating. As the result, at the stage where the wet coating has substantially completely been dried until the filler comes no longer movable in that coating, it comes about that the filler is unevenly so distributed as to be more contained in the vicinity of the surface of the wet coating being dried.

In the present invention, the affinity means how the filler is more stably dispersed in either of water and the dispersion medium of the filler in the surface layer forming coating-liquid. More specifically, a filler in a weight equivalent to the filler contained in the surface layer forming coating-liquid according to the present invention may be dispersed in water, which is then left to stand, where the sedimentation rate of the filler in that water may be compared with the sedimentation rate of the filler in the surface layer forming coating-liquid, thus the extent of affinity can be judged. The filler shows a lower affinity where it settles faster, and the filler shows a higher affinity where it settles slower.

The present invention is described below in detail in the order of steps.

—Step (1)—

In the step (1) of the belt production process of the present invention, it is first necessary to prepare the surface layer forming coating-liquid. The coating-liquid according to the present invention may be prepared by appropriate selection and combination of a filler, a binder resin and a solvent.

Re Filler

The filler according to the present invention is what provides the surface layer of the electrophotographic belt with functionality. Accordingly, where the filler is added for the purpose of adjusting the electrical resistance of the surface layer, a conductive filler may be used as the filler. Where it is added to control the tackiness of the surface layer, a filler may be used which is suited to roughening the surface of the surface layer and has a good wear resistance.

Whatever filler is used, the filler is required to be a filler the affinity for water of which can be higher than its affinity for the dispersion medium of the coating-liquid when made into the surface layer forming coating-liquid.

A filler having such properties may include, e.g., zinc antimonate and titanium oxide.

Re Binder Resin

The binder resin may preferably be what provides the surface layer with good flexibility and wear resistance. It may include as specific examples thereof ultraviolet-curable acrylic resins and acrylic urethane resins. Any of these may optionally be so made up that part of hydrogen atoms has been substituted with a fluorine atom or a silicon atom.

Re Surface Layer Forming Coating Liquid

The surface layer forming coating liquid contains the filler described above and a dispersion medium of the filler. The binder resin makes up part of the dispersion medium. Then, the dispersion medium is so controlled that the affinity the filler has for the dispersion medium is lower than the affinity the filler has for the water. Such a coating-liquid may be prepared by appropriate selection and combination of the above materials.

Stated specifically, the affinity may be controlled as above by changing the mixing proportion of a hydrophobic solvent to water or to a hydrophilic solvent. More specifically, the mixing proportion of these solvents may appropriately be selected in accordance with the degree of hydrophilicity of the filler to be dispersed in the coating-liquid. For example, where the zinc antimonate or titanium oxide, having a good affinity for the water, is used as the filler, the hydrophobic solvent may be used in a larger proportion, and this makes the filler have a lower affinity for the dispersion medium. On the other hand, the water or hydrophilic solvent may be used in a larger proportion, and this makes the filler have an improved affinity for the dispersion medium. Here, the hydrophobic solvent may include as an example thereof a ketone-type solvent such as methyl ethyl ketone. The hydrophilic solvent may include as an example thereof a lower alcohol having approximately 1 to 3 carbon atoms. In particular, 2-propanol is preferred as the solvent of the coating-liquid because the above filler can be improved in dispersibility in the coating-liquid.

The filler itself may also be subjected to known hydrophilic treatment, and this can improve its affinity for the water. Such known hydrophilic treatment may include treatment with a dispersant having both hydrophilic groups and hydrophobic groups, and treatment to modify the filler itself chemically with hydrophilic groups.

The surface layer forming coating liquid according to the present invention may specifically be composed as shown below.

Coating-Liquid Example 1

Filler: zinc antimonate, 2.5 parts by mass.
Dispersion medium composed of:
binder resin: ultraviolet-curable acrylic resin monomer, 50 parts by mass;
methyl ethyl ketone, 90 parts by mass; and
2-propanol, 10 parts by mass.

Coating-Liquid Example 2

Filler: titanium oxide, 2.5 parts by mass.
Dispersion medium composed of:
binder resin: ultraviolet-curable acrylic resin monomer, 50 parts by mass;
methyl ethyl ketone, 90 parts by mass; and
2-propanol, 10 parts by mass.

—Steps (2) and (3)—

In the step (2) of the belt production process of the present invention, water is made to adhere to the surface of the wet coating of the surface layer forming coating liquid, formed in the step (1).

Where there is a great difference between the affinity the filler has for the water and the affinity the filler has for the dispersion medium of the coating-liquid, the filler is fast drawn to the water. Hence, the effect of the filler being unevenly so distributed as to be more contained on the surface side may readily be obtained even where the water made to adhere to the wet-coating surface is in a small quantity.

Where on the other hand the difference is small between the affinity the filler has for the water and the affinity the filler has for the dispersion medium of the coating-liquid, the filler is relatively slowly drawn to the water. Hence, it is better for the water to be made to adhere to the wet-coating surface in a larger quantity.

As a method for making the water adhere to the wet-coating surface, it is particularly preferable to make the water adhere to the wet-coating surface by condensation. More specifically, an organic solvent may be kept contained in the coating-liquid, and the organic solvent may be vaporized in the step (3) of drying the wet coating and at the same time the temperature and humidity in the drying step may be controlled, whereby the wet-coating surface cooled upon vaporization can uniformly be sweated with water. Thus, a belt having a uniform surface state can be obtained with ease.

The level of condensation of the wet-coating surface may also arbitrarily be changed by controlling the humidity at this stage. Further, the drying step may be carried out in an environment of high humidity, where the surface can be sweated with much water, or instead it may be carried out in an environment of low humidity, where the surface can be sweated with less water.

For example, in the case when the coating-liquid of Coating-Liquid Example 1 is used, the wet coating may be placed in an environment of a temperature of 23° C. and a relative humidity of 60% RH, whereby the surface of the wet coating can be sweated as the organic solvent is vaporized immediately after the wet coating has been formed. This makes the filler move on to the surface side of the wet coating, so that, at a point of time where the wet coating has substantially completely been dried, a film can be obtained on the surface side of which the filler is unevenly so distributed as to be more contained.

As another method for making the water adhere to the wet-coating surface, a method is also available in which atomized water is sprayed on the surface by ultrasonic spraying. In this case, in order to accelerate the uneven distribution that is so made for the filler as to be more contained on the surface side, the water may preferably be sprayed immediately after the wet coating has been formed.

The drying in the step (3) may preferably be started substantially simultaneously with the step (2). The mobility of the filler decreases with progress of the drying of the wet coating. Hence, immediately after the wet coating has been formed, the water may be made to adhere to the wet-coating surface, in the state of which the drying of the step (3) may be made to proceed. This enables the filler to be surely moved to the surface side of the wet coating.

After the solvent in the wet coating has completely been evaporated, the coating dried may further be heated, or irradiated with ultraviolet rays, depending on the type of the binder resin, to cure the binder resin to form a protective layer as the surface layer 102.

Re Configuration of Belt

The electrophotographic belt according to the present invention may at least be made up of the base layer 101 and the surface layer 102 to have a double-layer structure, as shown in FIG. 1. Thus, it may also have a triple-layer structure consisting of the base layer, an intermediate layer and the surface layer, or may have a multiple-layer structure consisting of more layers.

The resin constituting the base layer 101 is not fundamentally limited as long as it satisfies the flexibility and mechanical strength required as the belt. However, from the viewpoint of cost, durability and moldability, it is preferable for the resin to contain polyethylene naphthalate.

Electrophotographic Image Forming Apparatus

The electrophotographic image forming apparatus according to the present invention is described next, giving a specific example.

Figure 2:
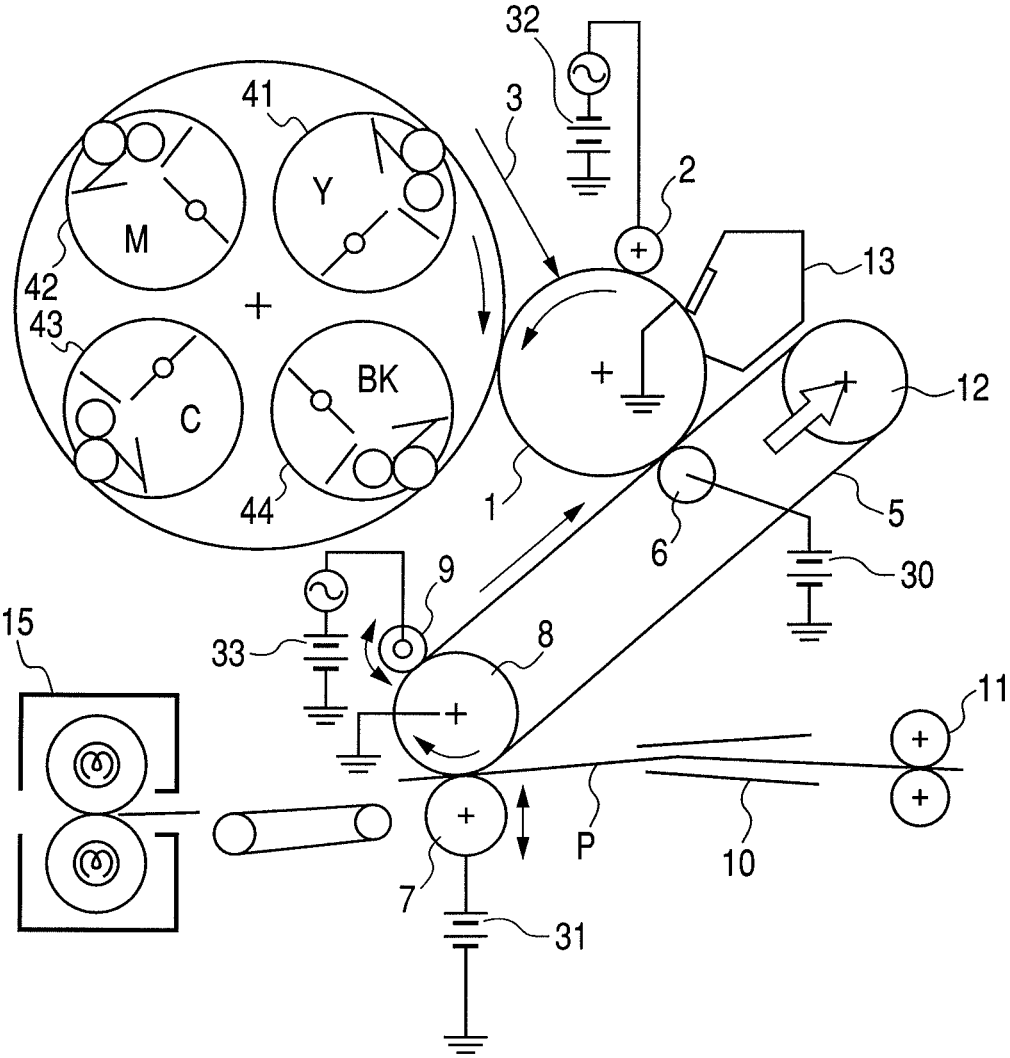
FIG. 2 is a schematic view showing an example of a full-color image forming apparatus of an electrophotographic system making use of a belt.

An example of a full-color electrophotographic image forming apparatus (copying machine or laser beam printer) making use of the belt according to the present invention as a seamless belt is shown in FIG. 2. In the full-color electrophotographic image forming apparatus shown in FIG. 2, the seamless belt is used as an intermediate transfer belt 5, and a medium-resistance seamless belt for electrophotography is used.

An electrophotographic photosensitive member (hereinafter "photosensitive drum") 1 is a rotary drum-type photosensitive drum used repeatedly as a first image bearing member, which is rotatingly driven at a stated peripheral speed (process speed) in the direction of an arrow.

The photosensitive drum 1 is, in the course of its rotation, uniformly electrostatically charged to stated polarity and potential by means of a primary charging assembly 2 connected to a power source 32. Then, it is imagewise exposed to exposure light 3 emitted from an exposure means (not shown; e.g., a color original image color-separating and image-forming optical system, or a scanning exposure system comprising a laser scanner that outputs laser beams modulated in accordance with time-sequential electrical digital pixel signals of image information). Thus, an electrostatic latent image is formed which corresponds to a first color component image (e.g., a yellow color component image) of the intended color image.

Next, the electrostatic latent image is developed with a first-color, yellow toner Y, by means of a first developing assembly (yellow color developing assembly 41). At this stage, second to fourth developing assemblies (a magenta color developing assembly 42, a cyan color developing assembly 43 and a black color developing assembly 44) each stand unoperated and do not act on the photosensitive drum 1, and hence the first-color yellow toner image is not affected by the second to fourth developing assemblies.

The intermediate transfer belt 5 is stretched over a tension roller 12 and a secondary-transfer opposing roller 8, and is rotatingly driven in the direction of an arrow at the same peripheral speed as the photosensitive drum 1.

The first-color yellow toner image formed and held on the photosensitive drum 1 passes through a nip zone formed between the photosensitive drum 1 and the intermediate transfer belt 5, in the course of which it is successively intermediately transferred to the peripheral surface of the intermediate transfer belt 5 (primary transfer) by the aid of an electric field formed by a primary transfer bias applied to the intermediate transfer belt 5 through a primary transfer opposing roller 6.

The photosensitive drum 1 surface from which the first-color yellow toner image has been transferred to the intermediate transfer belt 5 is cleaned by a cleaning assembly 13.

Subsequently, the second color magenta toner image, the third color cyan toner image and the fourth color black toner image are sequentially likewise transferred superimposingly onto the intermediate transfer belt 5. Thus, a synthesized color toner image is formed.

A secondary transfer roller 7 is provided in such a way that it is axially supported in parallel to a secondary transfer opposing roller 8 and stands separable from the bottom surface of the intermediate transfer belt 5.

The primary transfer bias for sequentially superimposingly transferring the first- to fourth-color toner images from the photosensitive drum 1 to the intermediate transfer belt 5 is applied from a power source 30 in a polarity (+) reverse to that of each toner. The voltage thus applied is, e.g., in the range of from +100 V to +2 kV.

In the step of primary transfer of the first- to third-color toner images from the photosensitive drum 1 to the intermediate transfer belt 5, the secondary transfer roller 7 may be separated from the intermediate transfer belt 5.

The synthesized color toner image transferred onto the intermediate transfer belt 5 is secondarily transferred to a second image bearing member, transfer material P, in the following way: First, the secondary transfer roller 7 is brought into contact with the intermediate transfer belt 5 and simultaneously the transfer material P is fed at a stated timing from a paper feed roller 11 through a transfer material guide 10 until it reaches a contact nip formed between the intermediate transfer belt 5 and the secondary transfer roller 7. Then, a secondary transfer bias is applied to the secondary transfer roller 7 from a power source 31. By the aid of this secondary transfer bias, the synthesized color toner image is transferred (secondary transfer) from the intermediate transfer belt 5 to the second image bearing member, transfer material P. The transfer material P to which the synthesized color toner image has been transferred is guided into a fixing assembly 15, where this color toner image is heat-fixed.

After the synthesized color toner image has been transferred to the transfer material P, a cleaning charging member 9 of a cleaning assembly is brought into contact with the intermediate transfer belt 5, and a bias with a polarity reverse to that of the photosensitive drum 1 is applied by a power source 33, whereupon electric charges with a polarity reverse to that of the photosensitive drum 1 are imparted to toners not transferred to the transfer material P and remaining on the intermediate transfer belt 5 (i.e., transfer residual toners).

The transfer residual toners are electrostatically transferred to the photosensitive drum 1 at the contact zone between the photosensitive drum 1 and the intermediate transfer belt, and the vicinity thereof, thus the intermediate transfer belt is cleaned.

Conventionally available full-color electrophotographic image forming apparatus have had an image forming apparatus in which the second image bearing member, transfer material P, is attached or attracted onto a transfer drum and toner images are transferred thereto from the surface of the first image bearing member. Where any of envelopes, post cards, labels, thin paper (40 g/m2 paper), thick paper (200 g/m2 paper) and the like is used as the transfer material P, such full-color electrophotographic image forming apparatus have required any processing or control such that the transfer material is held with a gripper, is attracted or is made to have a curvature. In contrast thereto, the full-color electrophotographic image forming apparatus making use of the intermediate transfer belt as described above does not require such processing or control, where toner images can even be transferred to the second image bearing member, transfer material P. Hence, the second image bearing member, transfer material P, can be selected in great variety without regard to how wide it is, how long it is and how thick it is. A system called a tandem system is also available in which four image forming sections corresponding to yellow, magenta, cyan and black images are provided one behind another. This system enables high-speed image reproduction.

EXAMPLES

The present invention is described below in greater detail by giving specific Examples, to which, however, the present invention is by no means limited. In the following, "part(s)" refers to "part(s) by weight" unless particularly noted.

Preparation of Base Layer

A mixture of the following materials was kneaded and extruded by means of a twin-screw extruder at a temperature of 260° C. to 280° C., and the resin mixture obtained was crushed into pellets.

Polyethylene naphthalate (trade name: TN-8050SC; available from Teijin Chemicals Ltd.): 78 parts.

Polyether ester amide (trade name: IRGASTAT P20; available from Ciba Specialty Chemicals): 21 parts.

Potassium perfluorobutanesulfonate (available from Mitsubishi Materials Corporation): 1 part.

Figure 3:
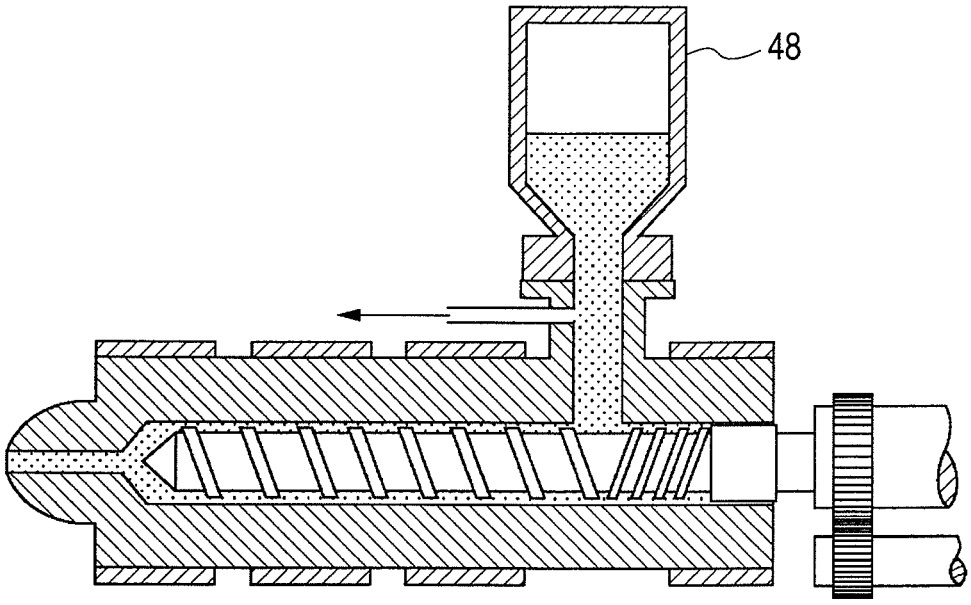
FIG. 3 is a schematic view showing an example of an injection molding equipment.

The pellets obtained were dried for 4 hours at 140° C. and then for 3 hours at 160° C. Thereafter, these were put into a hopper 48 of an injection molding equipment shown in FIG. 3, to carry out injection molding while controlling injection temperature at 270° C. and mold temperature at 18° C. to prepare a preform 104 shown in FIG. 4.

Figure 4:
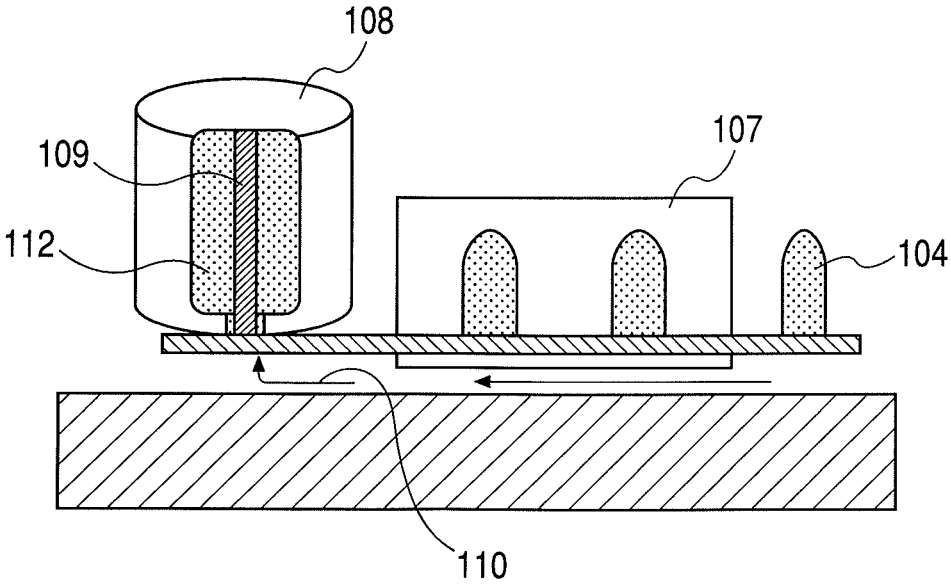
FIG. 4 is a schematic view showing an example of a stretch blow molding machine.
Figure 6:
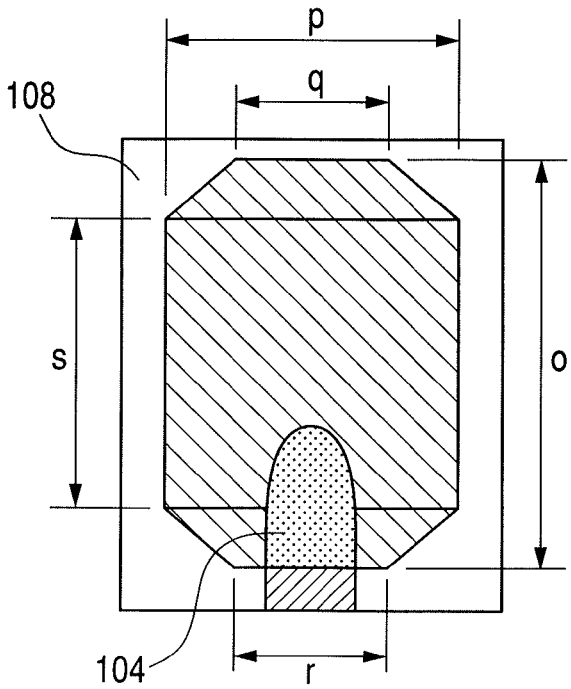
FIG. 6 is a schematic view showing an example of a stretch blow mold.

The preform 104 obtained was made to pass through a heating unit 107 shown in FIG. 4, where the preform was preheated at temperatures shown below. Thereafter, in a blow mold 108 shown in FIGS. 4 and 6, the preform was blow-stretched by the force of a stretching rod 109 and air 110 under blow molding conditions shown below to obtain a blow bottle 112. The blow mold 108 shown in FIG. 6 is a mold of a horizontal division type, and has a size of 140 mm at its portion p shown in FIG. 6, 60 mm at its portion q, 360 mm at its portion o, 260 mm at its portion s, and 100 mm at its portion r.

Blow Molding Conditions (1) Division of heater: divided into five.

Figure 5:
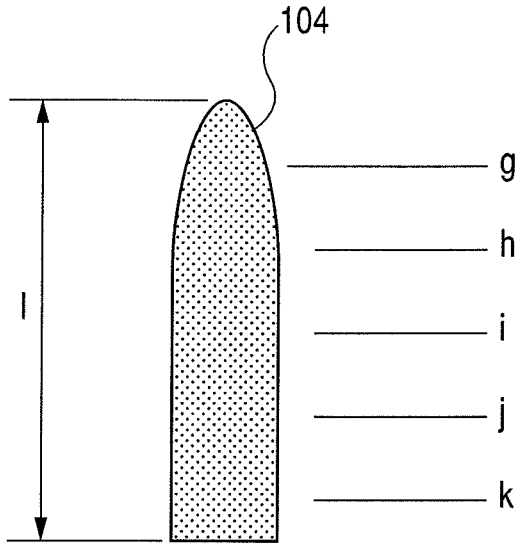
FIG. 5 is a schematic view showing an example of a preform.

(2) Preheating temperatures in blowing at respective heating positions (see FIG. 5) of preform:

(a) Position g (part corresponding to an end of the seamless belt) of preform: 140° C.;

(b) Position h of preform: 140° C.;

(c) Position i (part corresponding to the middle of the seamless belt) of preform: 150° C.;

(d) Position j of preform: 152° C.; and (e) Position k (part corresponding to another end of the seamless belt) of preform: 151° C.

(3) Stretching rod speed: 0.5 m/s.

(4) Primary pressure: 0.8 MPa.

(5) Time after the stretching rod begins to move until a gas is flowed in: 0.41 sec.

(6) Secondary pressure: 3.92 MPa.

(7) Blow mold temperature: 15° C.

Under the above blow molding conditions, it came in effect that the parts corresponding to the positions g to k were more stretched in the axial direction than the other parts (outside the range of the positions g to k).

The blow bottle obtained was cut at its both end portions by means of an ultrasonic cutter, leaving its middle portion (corresponding to the portion s of the mold) of 250 mm in length, thus a base layer of 140 mm in diameter, 250 mm in length and 75 μm in thickness was prepared as an intermediate transfer belt.

Preparation of Coating-Liquid

Raw materials formulated as shown in Table 1 were mixed with stirring in a beaker to obtain coating-liquids 1 to 3.

TABLE 1

| | | | Coating-liquid: | | |
|---|---|---|---|---|---|
| | | | 1 (parts) | 2 (parts) | 3 (parts) |
| Filler | | Zinc antimonate | 2.5 | — | — |
| | | Titanium oxide | — | 2.5 | — |
| | | Carbon black | — | — | 2.5 |
| Dispersion medium | Binder resin | Ultravioletcurable acrylic resin | 50 | 50 | 50 |
| | Solvents | MEK (2-butanone) | 90 | 90 | 90 |
| | | IPA (2-propanol) | 10 | 10 | 10 |

Ultraviolet-curable acrylic resin (trade name: DESOLITE; available from JSR Corporation).
Zinc antimonate (trade name: CELLNAX; available from Nissan Chemical Industries, Ltd.).
Carbon black (trade name: MHI BLACK #236; available from Mikuni Color Works Ltd.).
Titanium oxide (trade name: QUEEN TITANIC; available from Catalysts & Chemicals Industries Co., Ltd.).

Evaluation of Affinity of Filler

As described previously, dispersions prepared by respectively dispersing the filler in water and in the dispersion medium may be left to stand, and the sedimentation rates of the filler may be compared with each other, thus the extent of affinity can be judged. Here, the dispersion medium includes the binder resin as well.

Stated specifically, the affinity was evaluated in the following way. That is, 0.2 g of the filler was added to each of 20 ml of the water and 20 ml of the dispersion medium with stirring by means of a magnetic stirrer. The stirring was continued for 1 minute as it was. Thereafter, the dispersions obtained were all put into glass bottles, which were then so covered up as to be hermetically closed, and these were left to stand in the dark at room temperature as they were. How they stood was observed every stated hours, and a dispersion in which the filler had more settled was judged to be one showing a smaller affinity.

Where the affinity is to be more objectively judged, the transmittance of dispersions may be measured with a transmittance meter (trade name: TURBISCAN Lab Expert; manufactured by Formulaction) or the like to find the distribution of light intensity of transmission and backscattering as measured in the height direction. This is preferable because how the filler settles can be found quantitatively and with time.

The affinity the zinc antimonate, the titanium oxide and the carbon black each have for the dispersion mediums of the above coating-liquids 1 to 3 was evaluated to obtain the results shown in Table 2. The zinc antimonate and the titanium oxide were found to show a larger affinity for the water than for the dispersion medium, and the carbon black, a larger affinity for the dispersion medium of the coating-liquid than for water.

TABLE 2

| Filler | Relationship of extent of affinity, between filler and water or dispersion medium | Affinity for water | Affinity for dispersion medium of coating-liquid |
|---|---|---|---|
| Zinc antimonite: | Water > dispersion medium of coating-liquidl 1 | Substantially does not settle for 5 days. | Settles in 3 days. |
| Titanium oxide: | Water > dispersion medium of coating-liquid 2 | Substantially does not settle for 5 days. | Settles in 2 days. |
| Carbon black: | Water < dispersion medium of coating-liquid 3 | Settles in 1 hour or less. | Substantially does not settle for 5 days. |

Example 1

The base layer obtained in the manner described above was coated with the coating-liquid 1 by slit coating to form a wet coating. Here, it was coated while ultrasonic spraying of water was carried out in such a way that the water came to adhere to the wet-coating surface immediately after the wet coating was formed, followed by drying. After the drying, the coating dried was irradiated with ultraviolet rays to form a protective layer of about 1 μm in thickness, thus an electrophotographic belt was obtained. The protective layer of this belt was analyzed with an ESCA (electron spectroscopy for chemical analysis) instrument (trade name: QUANTUM 2000; manufactured by ULVAC-PHI, Inc.). As the result, it was ascertainable that the filler stood unevenly so distributed as to be more contained on the surface side of the protective layer.

The coefficient of friction of the protective layer surface was also measured in the following way. A friction tester (trade name: FRICTION PLAYER FPR-2100, linear reciprocal slide measurement (option); manufactured by RHESCA COMPANY LIMITED) was used, and as its touch point a urethane point (Shore hardness: 70 degrees; diameter: 5 mm) was used. Measured under conditions of a load of 300 g, a reciprocation speed of 30 cycle/minute and a reciprocation width of 50 mm. As the result, the coefficient of friction was found to be 1.5.

Next, the belt of this Example was set in an electrophotographic image forming apparatus (manufactured by CANON INC.) as its transfer transport belt. This electrophotographic image forming apparatus was placed in an environment of a temperature of 30° C. and a relative humidity of 80% RH, and was idled in the state its electrophotographic photosensitive drum came into direct contact with the transfer transport belt and in a mode where they move relatively at different peripheral speeds. At this point, whether or not any pulsation came about was observed which was to be caused by sticking between the transfer transport belt and the electrophotographic photosensitive drum. By observing it, any influence was observed which the coefficient of friction of the protective layer surface of the transfer transport belt might have on the travel performance of the belt under conditions severe enough to tend to cause the sticking between the belt and the photosensitive drum. As the result, any pulsation was not seen to have come about in the belt of this Example.

Comparative Example 1

The base layer obtained in the manner described above was coated with the coating-liquid 1 by slit coating in dry air of temperature 23° C. to form a wet coating. Then, the wet coating was dried in dry air of temperature 23° C. without making any water adhere to the surface of the wet coating. After the drying, the coating dried was irradiated with ultraviolet rays to form a protective layer of about 1 μm in thickness. The protective layer obtained was observed by ESCA to ascertain that the filler stood substantially uniformly distributed in its thickness direction.

The coefficient of friction of the protective layer surface of the belt obtained was measured to find that it was 2.0.

The belt of this Comparative Example was set in an electrophotographic image forming apparatus to make evaluation in the same way as in Example 1. As the result, the pulsation, meaning that the sticking came about between the belt and the electrophotographic photosensitive drum, was seen to have come about on the belt.

From comparison between Example 1 and Comparative Example 1 shown above, it can be understood that, according to the present invention, the filler can be unevenly so distributed as to be more contained on the surface side of the protective layer.

Example 2

The base layer obtained in the manner described above was coated with the coating-liquid 1 by slit coating to form a wet coating. Here, it was coated in an environment of a temperature of 23° C. and a humidity of 60% RH in such a way that the water came to adhere to the wet-coating surface by condensation immediately after the wet coating was formed, followed by drying. After the drying, the coating dried was irradiated with ultraviolet rays to form a protective layer of about 1 μm in thickness. The coefficient of friction of the protective layer surface of the belt thus obtained was found to be 1.6.

The belt of this Example was set in an electrophotographic image forming apparatus to make evaluation in the same way as in Example 1. As the result, the pulsation was seen not to have come about on the belt.

Example 3

The base layer obtained in the manner described above was coated with the coating-liquid 2 by slit coating to form a wet coating. Here, it was coated in an environment of a temperature of 23° C. and a humidity of 60% RH in such a way that the water came to adhere to the wet-coating surface by condensation immediately after the wet coating was formed, followed by drying. After the drying, the coating dried was irradiated with ultraviolet rays to form a protective layer of about 1 μm in thickness. The coefficient of friction of the protective layer surface of the belt thus obtained was found to be 1.6.

The belt of this Example was set in an electrophotographic image forming apparatus to make evaluation in the same way as in Example 1. As the result, the pulsation was seen not to have come about on the belt.

Comparative Example 2

The base layer obtained in the manner described above was coated with the coating-liquid 3 by slit coating to form a wet coating. Here, it was coated in an environment of a temperature of 23° C. and a humidity of 60% RH in such a way that the water came to adhere to the wet-coating surface by condensation immediately after the wet coating was formed, followed by drying. After the drying, the coating dried was irradiated with ultraviolet rays to form a protective layer of about 1 μm in thickness. The coefficient of friction of the protective layer surface of the belt thus obtained was found to be 1.9.

The belt of this Comparative Example was set in an electrophotographic image forming apparatus to make evaluation in the same way as in Example 1. As the result, the pulsation, meaning that the sticking came about between the belt and the electrophotographic photosensitive drum, was seen to have come about on the belt.

Comparative Example 3

The base layer obtained in the manner described above was coated on its surface with the coating-liquid 2 by slit coating in dry air of temperature 23° C. to form a wet coating, followed by drying. After the drying, the coating dried was irradiated with ultraviolet rays to form a protective layer of about 1 μm in thickness. The coefficient of friction of the protective layer surface of the belt thus obtained was found to be 1.9.

The belt of this Comparative Example was set in an electrophotographic image forming apparatus to make evaluation in the same way as in Example 1. As the result, the pulsation, meaning that the sticking came about between the belt and the electrophotographic photosensitive drum, was seen to have come about on the belt.

Comparative Example 4

A belt was produced in the same way as in Comparative Example 1 except that the coating-liquid 1 was changed for the coating-liquid 3. The coefficient of friction of the protective layer surface of the belt thus obtained was found to be 2.0.

The belt of this Comparative Example was set in an electrophotographic image forming apparatus to make evaluation in the same way as in Example 1. As the result, the pulsation, meaning that the sticking came about between the belt and the electrophotographic photosensitive drum, was seen to have come about on the belt.

In the intermediate transfer belt production process according to the present invention, a cover layer is formed by coating through the specific steps described above. Thus, it can provide an intermediate transfer belt having cover layer which has a low tackiness and also a superior durability, and the intermediate transfer belt obtained is favorably usable in various comprehensive image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-309706, filed Nov. 30, 2007, which is herein incorporated by reference in its entirety.

What is claimed is:

1. A process for producing an electrophotographic belt having a base layer and a surface layer, the process comprising the steps of:

(1) forming on the base layer a wet coating of a surface layer forming coating-liquid, the surface layer forming coating-liquid comprising a filler dispersed therein, and a binder resin dissolved therein;

(2) making water adhere to the surface of the wet coating by water spraying; and (3) drying the wet coating to form the surface layer;

wherein an affinity of the filler for water is higher than that for a dispersion medium of the filler in the surface layer forming coating-liquid.

2. The belt production process according to claim 1, wherein the binder resin is an acrylic resin.

3. The belt production process according to claim 1, wherein the filler is zinc antimonate.

4. The belt production process according to claim 1, wherein the surface layer forming coating-liquid further comprises at least one selected from the group consisting of methyl ethyl ketone and 2-propanol.

5. The belt production process according to claim 1, wherein the base layer comprises polyethylene naphthalate.

* * * * *